US005876844A

United States Patent [19]

Harris et al.

[11] Patent Number: 5,876,844

[45] Date of Patent: Mar. 2, 1999

[54] ANTISTATIC OPACIFYING LAYER FOR PHOTOGRAPHIC ROLL FILM

[75] Inventors: Valerie J. Harris; William A. Mruk, both of Rochester; Barry M. Brown, Webster, all of N.Y.

[73] Assignee: Eastman Kodak Company, Rochester, N.Y.

[21] Appl. No.: 842,457

[22] Filed: Apr. 24, 1997

[51] Int. Cl.[6] ..... G03C 3/00; G03C 3/02

[52] U.S. Cl. ..... 428/323; 428/513; 430/501; 430/510; 430/527; 430/538

[58] Field of Search ..... 430/510, 527, 430/538, 501, 536; 428/513, 323

[56] References Cited

U.S. PATENT DOCUMENTS

| | | | |
|---|---|---|---|
| 4,312,937 | 1/1982 | Kasper et al. | 430/538 |
| 4,452,846 | 6/1984 | Akao | 428/513 |
| 4,579,781 | 4/1986 | Akao | 428/513 |
| 4,584,234 | 4/1986 | Hirose et al. | 428/513 |
| 4,784,906 | 11/1988 | Akao | 428/513 |
| 5,360,701 | 11/1994 | Elton | 430/501 |

*Primary Examiner*—Richard L. Schilling
*Attorney, Agent, or Firm*—Carl F. Ruoff

[57] ABSTRACT

The present invention is a backing paper for photographic roll film. The backing paper includes a paper base having a first side and a second side. Superposed on the first side of the paper base is an antistatic opacifying layer which includes polyethylene and at least 10 weight percent of conductive carbon black particles, the carbon black particles having a surface chemistry of less than 1.5 percent by weight.

7 Claims, No Drawings

ANTISTATIC OPACIFYING LAYER FOR PHOTOGRAPHIC ROLL FILM

FIELD OF THE INVENTION

The present invention relates to a backing paper for use in roll films. More particularly, the present invention provides a backing paper for photographic roll film which is opaque, provides antistatic protection and is easily manufactured.

BACKGROUND OF THE INVENTION

A photographic roll film cartridge typically includes a flanged spool upon which is wound a long strip of backing paper to which has been attached on one side thereof a strip of light sensitive photographic film. The ends of the backing paper are positioned to extend beyond the ends of the film and constitute light protective leader and trailer strips for film which is interwound with the backing paper so that it separates adjacent revolutions of the film.

Roll film backing paper is paper which is attached to a roll of film. The purpose of the roll film backing paper is to provide an opaque back surface which acts as a lightlock for the film and to provide antistatic protection to the emulsion which is coated on the other side of the film. Typically roll film backing paper consists of a paper to which is laminated a plastic material containing carbon black particles. However, polymer backing papers used in the past have had a problem with adhesion of the carbon black and polymer blend to the paper. Prior art solutions to this adhesion problem include the use of adhesive copolymers and lamination. It would be desirable to have a backing paper which did not use adhesive copolymers or multiple laminations to provide adequate adhesion of the polymer blend to the backing paper.

U.S. Pat. No. 5,360,701 describes an antistatic backing paper for photographic roll film. This patent teaches that one can prepare an antistatic roll film backing paper for photographic roll film by applying a polyethylene layer to a paper substrate and then applying an opaque layer at a temperature high enough to bond to the polyethylene. The opaque layer consists of polyethylene and 7 to 10 weight percent mixture of conductive and nonconductive black particles. The mixture contains 20 to 80 weight percent conductive black particles. This patent also teaches that when the proportion of carbon black particles is more than 10 percent of the total weight of the polymer blend, the polyethylene melt cannot be readily extruded onto the paper base. Moreover, there is reduced adhesion of the polyethylene melt to the base.

U.S. Pat. No. 4,584,234 discloses a wrapping material for photographic materials produced by laminating layers on a paper support. The laminated layer includes a thermoplastic resin on one side of the paper support, the thermoplastic resin being a blend of high density polyethylene and low density polyethylene. The blend of polyethylene used in the examples has 5 weight percent carbon black.

U.S. Pat. No. 4,579,781 describes a material for packaging light-sensitive materials which consists of a laminate of a substrate, a polyethylene polymer layer which contains no light-shielding material and a laminate comprising a light-shielding material outside the polyethylene layer. Thus, this material is a composite laminate composed of a low density polyethylene film and a separate light-shielding layer.

There is a need for a polyethylene backing paper which has improved strength, friction properties and is easily manufactured. The present invention solves these problems by providing a single layer of polyethylene with conductive carbon black particles.

SUMMARY OF THE INVENTION

A backing paper for photographic roll film comprising a paper base having a first side and second side; an antistatic opacifying layer superposed on the first side of said paper base comprising polyethylene; at least 10 weight percent of conductive carbon black particles, the carbon black particles having a surface chemistry of less than 1.5 percent by weight.

DETAILED DESCRIPTION OF THE PREFERRED EMBODIMENTS

The present invention is a backing paper for photographic roll film. The backing paper includes a paper base having a first side and a second side. Superposed on the first side of the paper base is an antistatic opacifying layer which includes polyethylene and at least 10 weight percent of conductive carbon black particles. The carbon black particles must have a surface chemistry of less than 1.5 percent by weight. It is preferred that the carbon black particles have a particle size of from 10 to 50 nanometers. The backing paper of this invention has a resistivity of less than 10 log ohms. The backing paper of this invention can also contain additional addenda such as antioxidants, slip agents, heat stabilizers and pigments.

The paper support is formed of natural pulp as the principal component. Synthetic fiber and synthetic pulp can also be added. Regenerated pulp may also be used as a blend component. The preferred paper support includes hardwood bleached Kraft short fiber and softwood bleached Kraft long fiber in various amounts. The density of the paper support can vary from 30 lbs/3000 $ft^2$ to 50 lbs/3000 $ft^2$ with the preferred range being 36 lbs/3000 $ft^2$ to 42 lbs/3000 $ft^2$. The thickness of the paper base varies from 2 mils to 4 mils with the preferred thickness being from 2.3 to 3.0 mils.

The polyethylene used in the present invention has a melt index (MI) of between 4 and 10 with 6 being preferred. A polyethylene resin having a low MI will be too viscous and will result in the destruction of the carbon structure that is critical for the electrical properties of the backing paper of the present invention. It is preferred that a low density polyethylene having a density of from 0.91 to 0.925 g/cc is used. A medium density (0.926 to 0.94 g/cc) or a high density (0.941 to 0.965 g/cc) polyethylene can also be used.

The carbon black particles of the present invention are 80 to 100 percent conductive, preferably 100 percent conductive. Carbon blacks are crystallographically related to graphite and are intrinsic semiconductors. The degree of electrical conductivity imparted by a specific carbon black particle is related to its physical and chemical properties.

The basic unit of carbon black is a cluster or aggregation of particles permanently fused together during the manufacturing process. Surface area and structure characterize the physical properties of the primary aggregate and influence the degree of conductivity imparted by the carbon black. Surface area characterizes the size of the primary particle and its degree of microporosity. Higher surface area grades have more aggregates per unit weight, and since a larger number of aggregates in the polymer matrix results in smaller inter-aggregate distances, higher surface area grades are generally more electrically conductive at a given loading.

Structure, defined by the butyl phthatate absorption test, characterizes the number of particles which make up the primary aggregate and its shape. High structure aggregates have large, highly branched clusters of particles. This branching increases inter-aggregate contact, resulting in higher electrical conductivity.

Surface chemistry of carbon black also influences conductivity. During manufacture, chemisorbed oxygen complexes form on the surface of all furnace type carbon blacks. This is referred to as volatile content. These complexes act as insulators, rendering the carbon black less conductive. For purposes of the present invention conductive carbon blacks must have a surface chemistry or percent volatiles content of less than 1.5 percent by weight.

The carbon black particles range in size from 10 to 100 nm with 15 to 40 being preferred.

Various additives may be added to the polyethylene formulation. Examples of the additives are described below.

(1) Plasticizer; phthalic acid esters, glycol ester, fatty acid ester, phosphoric acid ester, etc.

(2) Stabilizer; lead compounds, cadmium compounds, zinc compounds, alkaline earth metal compounds, organic tin compounds, etc.

(3) Antistatic agent; cation surfactants, anion surfactant, nonionic surfactant, amphoteric surfactants, etc.

(4) Flame retardant; phosphoric acid ester, phosphoric acid ester halides, halides, inorganic materials, polyols containing phosphor, etc.

(5) Filler; alumina, caolin, clay, calcium carbonate, mica, talc, titanium oxide, silica, etc.

(6) Reinforcing agent; metallic fiber, potassium titanate fiber, glass fiber, glass milled fiber, carbon fiber, etc.

(7) Blowing agent; inorganic blowing agents, (ammonium carbonate, sodium hydrogen carbonate), organic blowing agents (nitroso compounds, azo compounds), etc.

(8) Vulcanizing agent; vulcanization accelerator, acceleration assistant, etc.

(9) Deterioration preventing agent; ultraviolet absorber, antioxidant, metal deactivator, peroxide decomposing agent, etc.

(10) Coupling agent; silane compounds, titanium compounds, chromium compounds, aluminum compounds, etc.

(11) Various thermal resin, rubbers, etc.

Lubricants or slip agents can also be added to the polyethylene resin of the present invention. The slip agent or lubricant used in the present invention includes saturated fatty acid amides, unsaturated fatty acid amides, bis(fatty acid) amides, silicones, nonionic surfactants, fatty acids, esters, alcohols and metal soaps. Examples of slip agents or lubricants suitable for the present invention include the following.

(1) Fatty acid amide type slip agents:

Saturated fatty acid amide type lubricants

1. Behenic acid amide lubricants; Dyamide KN (trade name, the product of Nippon Kasei Chemicals Co., Ltd.), and so on.
2. Stearic acid amide lubricants; Armide HT (trade name, the product of Lion Fat & Oil Co., Ltd.), Alflow S-10 (trade name, the product of Nippon Oils & Fats Co., Ltd.), Fatty Acid Amide S (trade name, the product of Kao Corporation), Dyamid 200 and Dyamid AP-1 (trade names, the products of Nippon Kasei Chemicals Co., Ltd.), Amide S and Amide T (trade names, the products of Nitto Chemical Industry Co., Ltd.), Newtron-2 (trade name, the product of Nippon Seika K.K.), and so on.
3. Palmitic acid amide lubricants; Newtron S-18 (trade name, the product of Nippon Seika K.K.), Amide C (trade name, the product of Nitto Chemical Industry Co., Ltd.) and so on.
4. Lauric acid amide lubricants; Armide C (trade name, the product of Lion Akuzo Co., Ltd.), Dyamid (trade name, the product of Nippon Kasei Chemicals Co., Ltd.), and so on.

Unsaturated fatty acid amide type lubricants

1. Erucic acid amide lubricants; Alflow P-10 (trade name, the product of Nippon Oils & Fats Co., Ltd.), Newtron-S (trade name, the product of Nippon Seika K.K.), Lubrole (trade name, the product of I.C.I. Co., Ltd.), Dyamid L-200 (trade name, the product of Nippon Kasei Chemicals Co., Ltd.), and so on.
2. Oleic acid amide lubricants; Armoslip CP (trade name, the product of Lion Akuzo Co., Ltd.), Newtron and Newtron E-18 (trade names, the products of Nippon Seika K.K.), Dyamid O-200 and Dyamid G-200 (trade names, the products of Nippon Kasei Chemicals Co., Ltd.), Alflow E-10 (trade name, the product of Nippon Oils & Fats Co., Ltd.), Fatty Acid Amide O (trade name, the product of Kao Corporation), and so on.

Bis(fatty acid)amide type lubricants

1. Methylenebis(behenic acid amide) lubricants; Dyamid NK Bis(trade name, the product of Nippon Kasei Chemicals Co., Ltd.), and so on.
2. Methylenebis(stearic acid amide) lubricants; Dyamid 200 Bis(trade name, the product of Nippon Kasei Chemicals Co., Ltd.), Armowax (tradename, the product of Lion Akuzo Co., Ltd), Bisamide (tradename, the product of Nitto Chemical Industry Co., Ltd), and so on.
3. Methylenebis(oleic acid amide) ubricants; Lubron O (trade name, the product of Nippon asei Chemicals Co., Ltd.), and so on.
4. Ethylenebis(stearic acid amide) lubricants; Armoslip EBS (trade name, the product of ion Akuzo Co., Ltd.), and so on.
5. Hexamethylenebis(stearic acid amide) lubricants; Amide 65 (trade name, the product of Kawaken Fine Chemicals, Ltd.), and so on.
6. Hexamethylenebis(oleic acid amide) lubricants; Amide 60 (trade name, the product of Kawaken Fine Chemicals, Ltd.), and so on.

(2) Silicone type lubricants:

Dimethylpolysiloxanes of various grades, modified products thereof and a wide variety of modified products of other silicones (represented by siloxanes) are included therein.

As typical examples thereof, mention may be made of carboxyl-modified silicones, α-methylstyrene-modified silicones, α-oleic acid modified silicones, polyether-modified silicones, fluorine-modified silicones, specially modified hydrophilic silicones, olefin polyether-modified silicones, epoxy-modified silicones, amide-modified silicones, alcohol-modified silicones, alkyl-modified silicones, alkylaryl-modified silicones, amino-modified silicones and alkyl- and hydrogen-modified silicones (produced by Shin-Etsu Silicone Co., Ltd.).

(3) Nonionic surfactant type lubricants:

Electrostipper TS-2 and TS-3 (trade names, the products of Kao Corporation) and so on are examples thereof.

(4) Hydrocarbon type lubricants:

Liquid paraffin, natural paraffin, micro wax, synthetic paraffin, polyethylene wax, polypropylene wax, chlorinated hydrocarbons, fluorocarbons and the like are examples thereof.

(5) Fatty acid type lubricants:

Higher fatty acids (especially $C_{12}$ fatty acids), oxyfatty acids and the like are examples thereof.

(6) Ester type lubricants:

Lower alcohol esters of fatty acids, polyhydric alcohol esters of fatty acids, polyglycol esters of fatty acids, aliphatic alcohol esters of fatty acids and the like are examples thereof.

(7) Alcohol type lubricants:

Polyhydric alcohols, polyglycols, polyglycerols and the like examples thereof.

(8) Metal soaps

The compounds of higher fatty acids, such as lauric acid, stearic acid, ricinolic acid, naphthenic acid, oleic acid, etc., with metals such as Li, Mg, Ca, Sr, Ba, Zn, Cd, Al, Sn, Pb, etc. are examples thereof.

The lubricants or slip agents as cited above may be used alone, or as a mixture of two or more thereof, if desired. The proportion of slip agent added is in the range of generally 0.001 to 1% by weight, preferably 0.005 to 1% by weight and particularly preferably 0.01 to 0.8% by weight.

The resin formulation of the present invention typically contains an antioxidant for stabilization. Classes of thio-containing antioxidants include thiophenols, dithiobisphenols, phenolic sulfides, monosulfides, disulfides, mercaptobenzimidazoles, thiols, mercaptothiazolines, sulfoxides, sulfones and metal dithiolates. Examples of thiophenols include 2,2'-thiobis-(4-methyl-6-tertiary butylphenol), 2,2'-thiodiethylene bis(3,5-di-tert-butyl-4-hydroxyhydrocinnamate), 4,4'-thiobis-(3-methyl-6-tertiary butylphenol), 2,2'-thiobis-(6-tert-butyl-4-methylphenol), 4,4'-thiobis(6-tertiary butyl meta-cresol) 4,4'-thiobis(6,5-butyl meta cresol), and 4,4'-thiobis(6-tertiary butyl ortho-cresol). An example of a dithiobisphenol is 4,4'-dithiobis-tertiary-butyl-m-cresol. An example of a phenolic sulfide is 3,5-di-tertiary-butyl-4-hydroxyphenylmethane. Examples of monosulfides include di-lauryl-3,3'-thiodipropionate and di-stearyl-3,3'-thiodipropionate. Examples of disulfides include 2-Naphthyldisulfide. An example of a thiol is 2-Naphthylenethiol. Examples of a mercaptobenzimidozole are 2-benzoimidazolethiol and its derivatives. Examples of metal dithiolates include [2,2'-thiobis(4-tertiary-octyl phenolato)]-n-butylamine and Nickel (II) zinc (II) dibutyldithiocarbonate. The antioxidant is required to prevent thermal degradation of the polymer resin and the formation of gels or fisheyes. The preferred thio containing antioxidant is 4,4'-thiobis(6-tertiary butyl meta-cresol). Nonthio containing antioxidants such as 4,4'-butylidene-bis(6-tert-butyl-meta-cresol), N-butylated-p-aminophenol, 2,6-di-tert-butyl-p-cresol, 2,2-di-tert-butyl-4-methyl-phenol, N,N-disalicylidene-1,2-diaminopropane, tetra(2,4-tert-butylphenyl)-4,4'-diphenyl diphosphonite, octadecyl 3-(3',5'-di-tert-butyl-4'-hydroxyphenyl propionate), octadecyl 3,5-di-tertiary-butyl-4-hydroxy-hydrocinnamate, tetrakis [methylene(3,5-di-tertiary-butyl-4-hydrocinnamate)] methane, 1,3,5-tris(4-tertiary-butyl-3-hydroxy-2,6-dimethylbenzyl), 1,3,5-triazine-2-4-6-(1H,3H,5H)-trione, combinations of the above, can also be used to stabilize the resin formulation.

The resin formulation of the present invention can also contain heat stabilizers, such as higher aliphatic acid metal salts such as magnesium stearate, calcium stearate, zinc stearate, aluminum stearate, calcium palmitate, sodium palmitate, zironium octylate, sodium laurate, and salts of benzoic acid such as sodium benzoate, calcium benzoate, magnesium benzoate and zinc benzoate.

Prior to the polymer extrusion step, the paper can be treated with a corona discharge, flame, glow discharge or any combination thereof to improve the adhesion of the polymer to the paper support. The polymer can also be treated with ozone to improve adhesion. The polymer can be extruded over a wide temperature range, i.e., 150° C.–340° C., and speeds, e.g., about 60 m/min. to 460 m/min., depending on the particular intended application of the support. For many applications, preferred extrusion temperatures are about 310°–330° C.

The present invention will now be described in detail with reference to the following examples; however, the present invention should not be limited by the following examples.

The formulation used in the present invention (Formulation 1) contains 10 percent conductive carbon black, 0.04 percent of a 50/50 blend of Irganox 1010 and Irganfos 168, 0.6 percent calcium stearate, 64.37 percent low density polyethylene with a melt index of 4.3 and a density of 0.923 g/cm$^3$, and 10 percent low density polyethylene with a melt index of 10 and a density of 0.923 g/cm$^3$.

The carbon black is a 50/50 blend of Degussa Printex XE2 and Printex L6. The Printex XE2 is a 35 nm, highly conductive grade carbon black. The Printex L6 is an 18 nm, conductive grade carbon black. Both carbon blacks have low levels of the oxygen containing surface groups such as lactols, carboxyls, phenols, and carbonyls. The quantity of oxygen containing surface groups on the carbon black is measured by cracking at 950° C. The total volatiles or surface chemistry for both carbon blacks is less than 1.5 percent which allows maximum conductivity at the lowest carbon black loadings.

The polyethylene formulation of the present invention is preferably extruded through various extrusion screws including a barrier screw, a double flight-double mixer and a single stage-single flight mixer.

The surface resistivity measurement was conducted at room temperature and 50 percent relative humidity. The coating uniformity was monitered by measuring the thickness of the polymer layer over a 30 foot section. A pinhole is a microscopic hole in the polymer backing. Pinholes were measured in a darkroom by placing two square feet of backing paper over a flood lamp light table. A pinhole appears as a tiny spec of light. The number of light specs observed in 15 square feet of backing paper was recorded.

The following examples serve to illustrate the present invention. The formulation described previously was prepared and extruded at various temperatures and speeds through a single flight single stage mixer. The results are shown in Table 1.

TABLE 1

| Example | Melt Temp (F.) | RPM's | Speed (ft/min) | Adhesion to Paper |
|---|---|---|---|---|
| 1 | 571 | 281 | 140 | Excellent |
| 2 | 576 | 288 | 113 | Excellent |
| 3 | 600 | 150 | 295 | Excellent |
| 4 | 600 | 153 | 305 | Excellent |
| 5 | 600 | 104 | 400 | Excellent |

As can be seen in Table 1, the adhesion of this formulation was excellent in all cases.

COMPARATIVE EXAMPLE A

A polyethylene blend containing 6% Cabot BP 2000 which is an 18 nm coductive carbon black powder. The surface chemistry or volatile content was 1.5%. A 4% opaque black having a size of 14 nm and a voltile content of 2% and 90% by weight of a 6 MI resin was compounded with polyethylene. The resins were dried and extrusion coated (600 melt temperature) onto Kraft paper.

EXAMPLE B

The polyethylene blend (Formulation 1) described previously was compounded on a batch banbarry. The resulting resin was dried and extrusion coated (600 melt temperature) onto the Kraft paper.

TABLE 2

| Sample | Pinholes (per 15 $ft^2$ | Optical Density | Coating Uniformity (mils of poly) | Surface Resistivity (log ohms) |
|---|---|---|---|---|
| Comp. Example A | 450 | 5–12 | 0.5–4.5 | 5–11 |
| Example B | 15 | 12–13 | 1.3–1.7 | 5–6 |

The optical density is the metric used to determine the opacity of a backing paper. A known illuminating source is shown through the backing paper and the quantity of light transmitted is measured. Transmission density is defined by the equation:

$$D_t = -\log_{10} T$$

where D is the optical density and T quantity of transmitted light. The backing paper requires that the optical density be greater than 8.

Optical densities of 9 and greater are considered to be opaque and would not cause a problem for the silver halide film. Optical densities of less than 8 are transparent and would allow sufficient light to expose a silver halide film.

Superior optical characteristics are the combination of low pinholes and high optical density. The formulation of the present invention provides 15 pinholes per 15 $ft^2$ while Comparison Example A has 450 pinholes per 15 $ft^2$. The optical density of the formulation of the present invention is greater than 12 while Comparison Example A is varible and ranges from opaque to tranparent. Comparison Example A would not be acceptable for backing papers.

Table 2 shows that the resin-coated paper of the present invention provides superior optical characteristics and superior antistatic protection than Comparative Example A.

While there has been shown what are presently considered to be the preferred embodiments of the invention, various modifications and alterations will be obvious to those skilled in the art. All such modifications are intended to fall within the scope of the appended claims.

What is claimed is:

1. A backing paper for photographic roll film comprising:

a paper base having a first side and second side;

an antistatic opacifying layer directly adhered to the first side of said paper base comprising:

polyethylene;

at least 10 weight percent conductive carbon black particles, said carbon black particles having a surface chemistry of less than 1.5 percent by weight.

2. The backing paper of claim 1, wherein the carbon black particles have a particle size of from 10 to 100 nm.

3. The backing paper of claim 1, wherein said antistatic opacifying layer has a resistivity of less than 10 log ohms.

4. The backing paper of claim 1, wherein the opacifying antistatic layer has an optical density of 9 or greater.

5. The backing paper of claim 1, wherein the polyethylene has a density of from 0.91 to 0.925 g/cc.

6. The backing paper of claim 1, wherein said antistatic opacifying layer further comprises an antioxidant.

7. The backing paper of claim 1, wherein said antistatic opacifying layer further comprises plasticizers, stabilizer, antistatic agents, flame retardants, filler, reinforcing agents, blowing agents, vulcanizing agents, deterioration preventing agents, coupling agent, or lubricants.

* * * * *